US008435068B2

(12) United States Patent
Oomori

(10) Patent No.: US 8,435,068 B2
(45) Date of Patent: May 7, 2013

(54) CONNECTOR

(75) Inventor: Hiroyuki Oomori, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 20 days.

(21) Appl. No.: 13/253,297

(22) Filed: Oct. 5, 2011

(65) Prior Publication Data

US 2012/0135640 A1 May 31, 2012

(30) Foreign Application Priority Data

Nov. 29, 2010 (JP) ..... 2010-265061

(51) Int. Cl.
*H01R 13/58* (2006.01)

(52) U.S. Cl.
USPC ..... 439/465

(58) Field of Classification Search ..... 439/465, 439/471, 470
See application file for complete search history.

(56) References Cited

U.S. PATENT DOCUMENTS 4,900,277 A * 2/1990 Inaba et al. ..... 439/752
5,762,520 A 6/1998 Martin
6,837,745 B2 * 1/2005 Takada et al. ..... 439/595
7,201,592 B2 * 4/2007 Hata ..... 439/206
7,435,090 B1 10/2008 Schriefer et al.
7,476,121 B2 * 1/2009 Tsuji ..... 439/471
7,588,454 B2 * 9/2009 Nakata et al. ..... 439/357
7,614,917 B2 * 11/2009 Yamaguchi et al. ..... 439/658
2008/0280467 A1 11/2008 Tsuji
2009/0029579 A1 * 1/2009 Hiramatsu ..... 439/147
2009/0098778 A1 * 4/2009 Murakami et al. ..... 439/701

FOREIGN PATENT DOCUMENTS

JP 2004-348988 12/2004
WO 2009001901 A1 12/2008

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

A housing (10) made of synthetic resin is formed with a pair of interference surfaces (17A, 17B) symmetrical with respect to a virtual axis of symmetry (S) and oblique to the virtual axis of symmetry (S) and receiving portions (16) spaced apart from the interference surfaces (17A, 17B) in a direction of the virtual axis of symmetry (S). The upper and lower covers (21A, 21B) of wire (20) are formed with interference portions (27) that come into contact with only parts of the pair of interference surfaces (17A, 17B), and contact portions (26) that come into contact with the receiving portions (16). The interference portions (27) contact the interference surfaces (17A, 17B) and plastically deform when the housing (10) and the wire cover (20) are connected and the receiving portions (16) and the contact portions (26) are held in contact.

15 Claims, 11 Drawing Sheets

CONNECTOR

BACKGROUND OF THE INVENTION

1. Field of the Invention

The invention relates to a connector.

2. Description of the Related Art

Japanese Unexamined Patent Publication No. 2004-348988 discloses a connector with a housing for housing terminal fittings and a wire cover to be mounted on the housing for covering wires pulled out from the housing. The wire cover is formed with a guide groove and the housing is formed with a guide that can be fit in the guide groove to prevent backlash between the housing and the wire cover. A backlash preventing rib formed in the guide groove is pressed and compressed by a slide-contact surface on the guide to eliminate a clearance between the guide groove and the guide.

The above-described backlash preventing structure prevents backlash by reliably preventing a relative displacement of the housing and the wire cover in a direction perpendicular to the slide-contact surface of the guide. However, relative displacement of the housing and the wire cover in a direction parallel to the slide-contact surface only is suppressed by friction produced by pressing and compressing the backlash preventing portion and hence backlash is not be prevented reliably.

The invention was completed in view of the above situation and an object thereof is reliably preventing backlash in two directions perpendicular to each other.

SUMMARY OF THE INVENTION

The invention relates to a connector with first and second components made of synthetic resin and configured to be connected to one another. Two interference surfaces are formed on the first component and extend substantially along a connecting direction of the first and second components. The interference surfaces are symmetrical with respect to a virtual axis of symmetry on a plane perpendicular to the connecting direction and oblique to the virtual axis of symmetry. At least one receiving portion on the first component extends substantially along the connecting direction and is spaced from the interference surfaces in a direction parallel to the virtual axis of symmetry. Two interference portions are formed on the second component and extend substantially along the connecting direction. The interference portions can contact only parts of the interference surfaces and are symmetrical with respect to the virtual axis of symmetry. At least one contact portion is formed on the second component to extend substantially along the connecting direction and can contact the receiving portion. The interference surfaces and the interference portions are set to be held in contact while at least either the interference surfaces or the interference portions are deformed plastically when the first and second components are connected and the receiving portion and the contact portion are held in contact.

Both of the interference portions invariably are held in contact with only the parts of the interference surfaces to prevent backlash of the first and second components when the first and second components are connected and the receiving portion and the contact portion are held in contact. The interference surfaces are oblique to two directions, namely the direction parallel to the virtual axis of symmetry and the direction perpendicular to the virtual axis of symmetry. Thus, backlash of the first and second components is prevented reliably in these two directions perpendicular to each other.

When Lmax denotes a maximum dimension from the receiving portion to the interference surfaces in the direction parallel to the virtual axis of symmetry, Lmin denotes a minimum dimension from the receiving portion to the interference surfaces in the direction parallel to the virtual axis of symmetry, Lo denotes a dimension from the contact portion to the interference portions in the direction parallel to the virtual axis of symmetry, Dmax denotes a maximum dimension between the interference surfaces in a direction perpendicular to the virtual axis of symmetry, Dmin denotes a minimum dimension between the interference surfaces in the direction perpendicular to the virtual axis of symmetry and Do denotes a dimension between the interference portions in the direction perpendicular to the virtual axis of symmetry, the dimensions Lmax, Lmin, Lo, Dmax, Dmin and Do satisfy the following inequalities (1) and (2);

$$Lmax>Lo>Lmin \quad (1)$$

$$Dmax>Do>Dmin \quad (2)$$

The interference surfaces preferably face in a direction opposite to the receiving portion in the direction parallel to the virtual axis of symmetry; and dimensions Lp, Lo are set to satisfy the following inequality (3):

$$Lp>Lo \quad (3)$$

when Lp denotes a dimension from positions on the interference surfaces where the dimension between the interference surfaces is Do to the receiving portion.

When the interference surfaces are facing in the direction opposite to the receiving portion in the direction parallel to the virtual axis of symmetry, the interference surfaces and the interference portions can be brought reliably into contact to prevent backlash if Lp>Lo when Lp denotes the dimension from the receiving portion to the positions on the interference surfaces where the dimension between the interference surfaces is Do.

At least one of the interference surfaces, the receiving portion, the interference portions and the contact portion may have a guide oblique to the connecting direction.

The guide corrects displacements of the first and second components in the process of connecting the components. Thus, operability is improved.

The second component preferably includes first and second elements that are connected to the first components in opposite directions while sandwiching the first component.

The first and second elements of the second component preferably are locked in their connected state by locks.

The first component and the first and second elements of the second component preferably are held in contact at the guide in a state where the locks engaged each other to prevent separation of the first and second elements.

The first component and the first and second elements of the second component preferably are held in contact at the guide portion oblique to the connecting direction when the locks are engaged to prevent separation of the first and second elements. This prevents relative displacements of the first and second elements in the connecting and separating directions and also prevents backlash between the first and second elements and the first component in the connecting and separating directions.

The first and second components preferably are bilaterally symmetrical with respect to the virtual axis of symmetry.

At least parts of the interference surfaces preferably are deformed plastically to be slightly concave when the first and second components are connected and the receiving portion and the contact portion are held in contact.

Preferably, only partial areas of the interference surfaces contact the interference portion in a direction perpendicular to the connecting direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
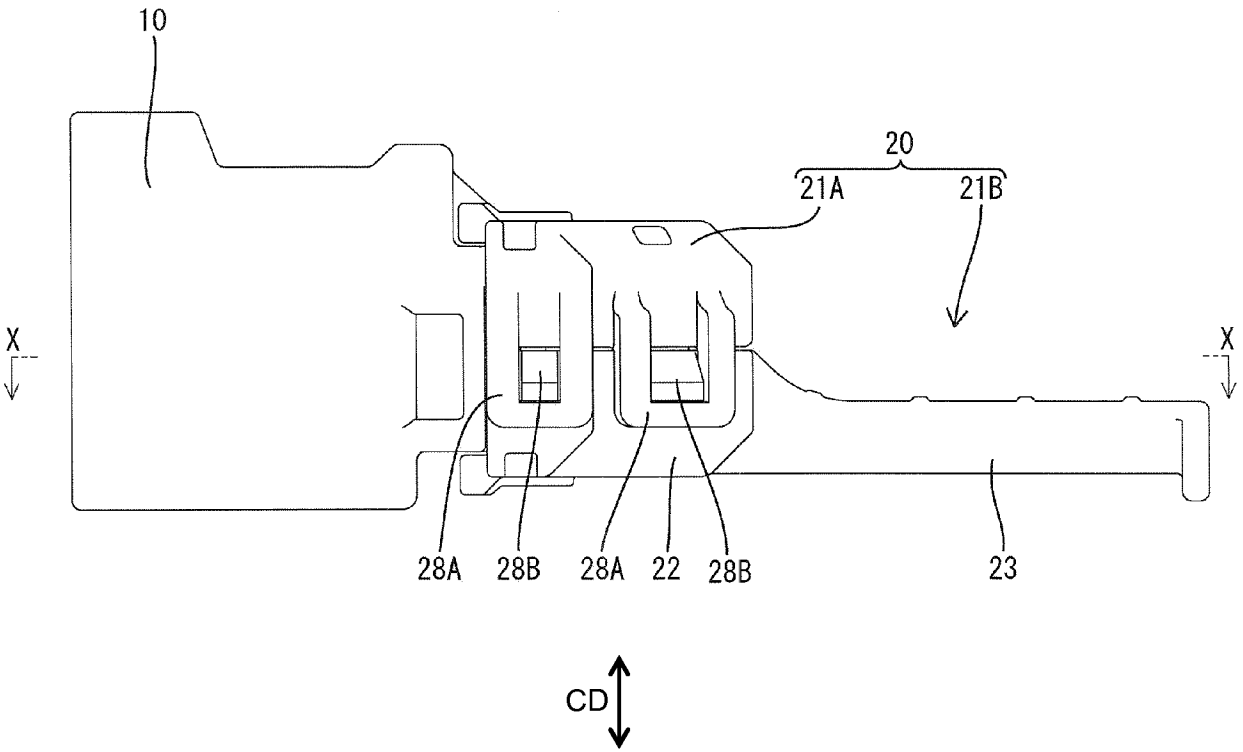
FIG. 1 is a side view of an assembled connector of the invention.
Figure 2:
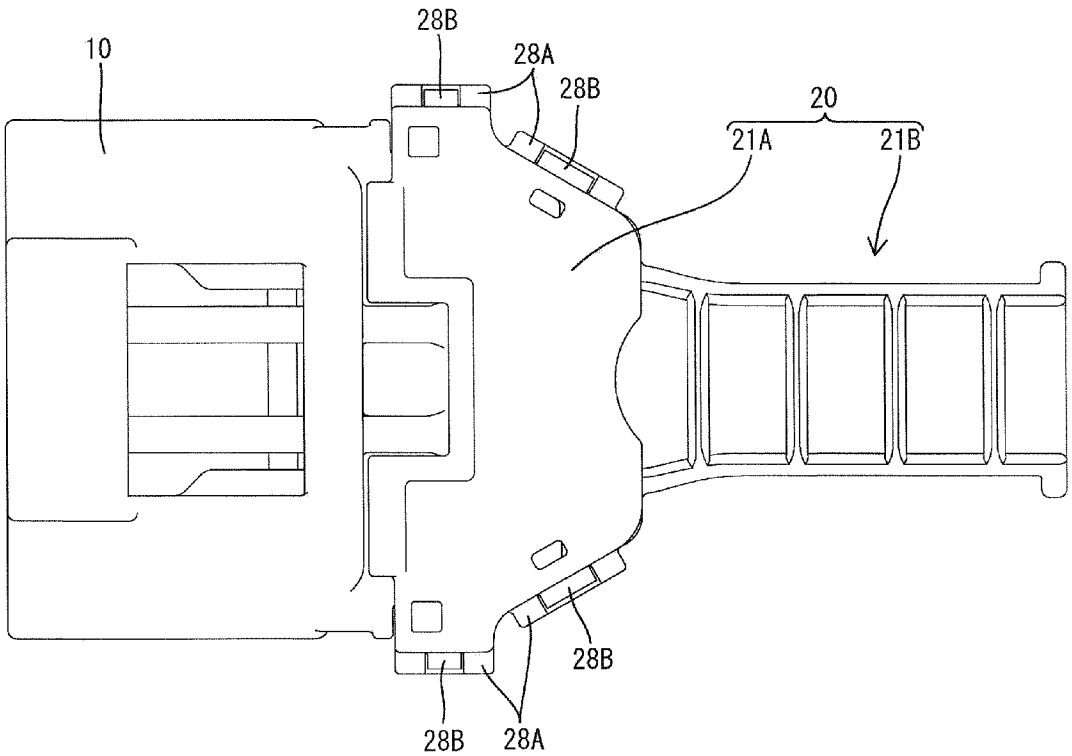
FIG. 2 is a plan view of the assembled connector.
Figure 3:
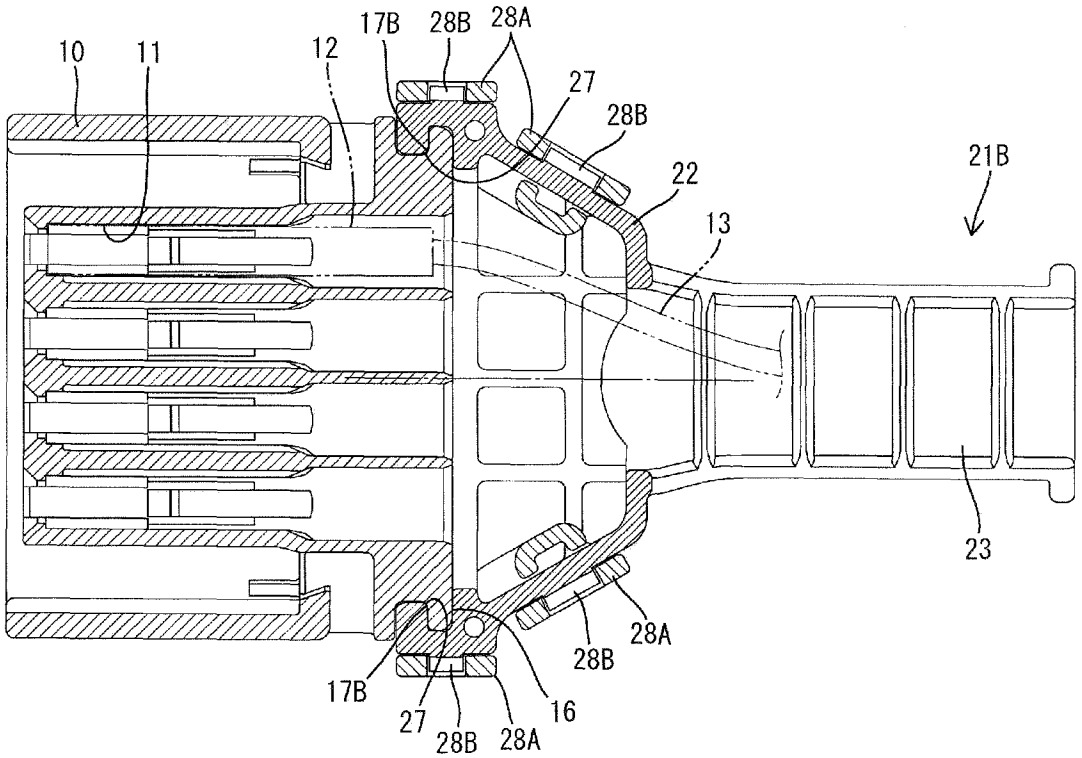
FIG. 3 is a section along X-X of FIG. 1.

A connector in accordance with the invention includes a housing identified generally by the numeral 10 in FIGS. 1 to 3, a housing 10 made of synthetic resin and a wire cover 20 to be mounted on a rear end portion of the housing 10. The wire cover 20 is formed by laterally or vertically connecting upper and lower covers 21A and 21B, both of which are made of synthetic resin. A connecting direction CD of the upper and lower covers 21A, 21B is substantially parallel to a connecting direction CD of the upper cover 21A to the housing 10 and a connecting direction CD of the lower cover 21B to the housing 10.

As shown in FIG. 3, terminal accommodating chambers 11 penetrate the housing 10 in forward and backward directions (lateral direction in FIG. 3) and are arranged substantially side by side in a width direction (vertical direction in FIG. 3) at one or more stages. Terminal fittings 12 are inserted into the respective terminal accommodating chambers 11 from behind the housing 10. Wires 13 are connected to rear end portions of the respective terminal fittings 12 and are pulled out from the rear end of the housing 10 while being spread laterally at positions corresponding to positions of the terminal fittings 12 in the terminal accommodating chambers 11. The wires 13 pulled out from the housing 10 are to be accommodated in the wire cover 20 to narrow their pull-out path in the width direction.

Figure 7:
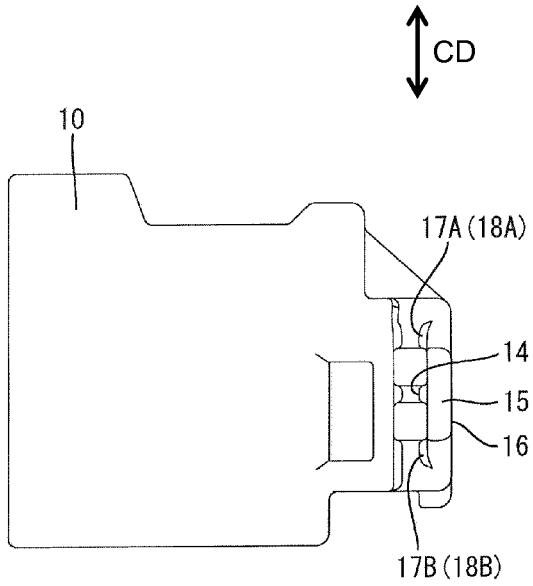
FIG. 7 is a side view of the housing.
Figure 8:
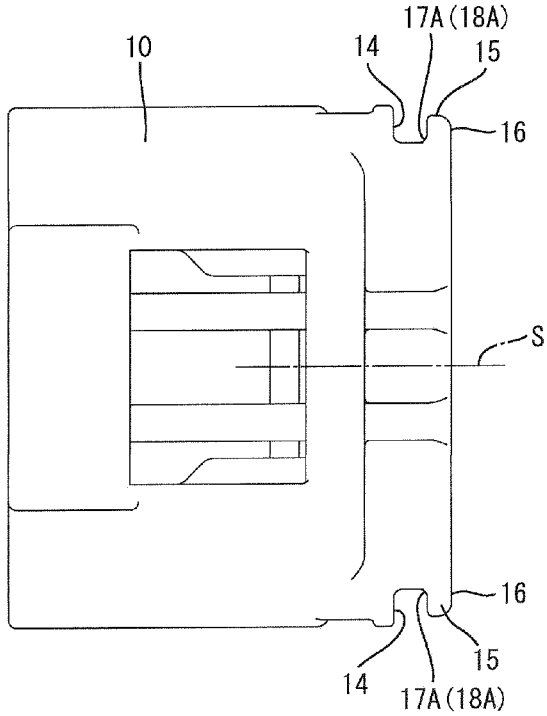
FIG. 8 is a plan view of the housing.
Figure 9:
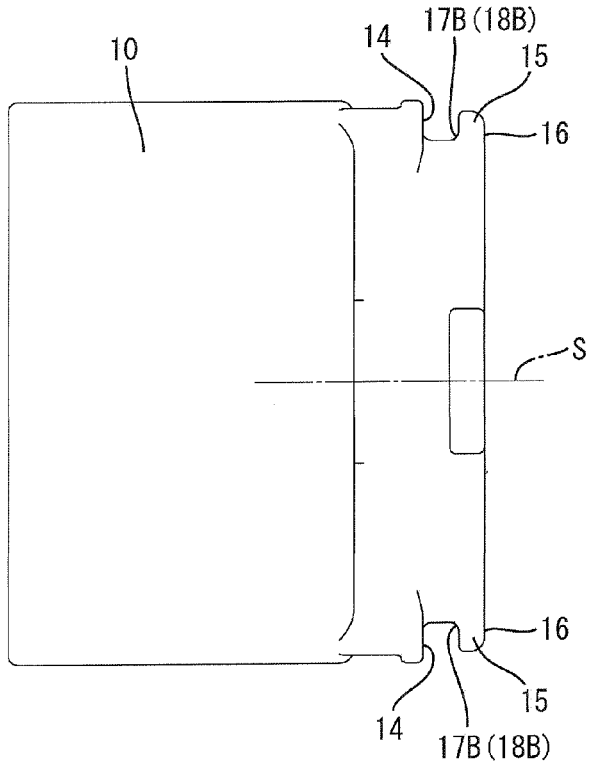
FIG. 9 is a bottom view of the housing.
Figure 10:
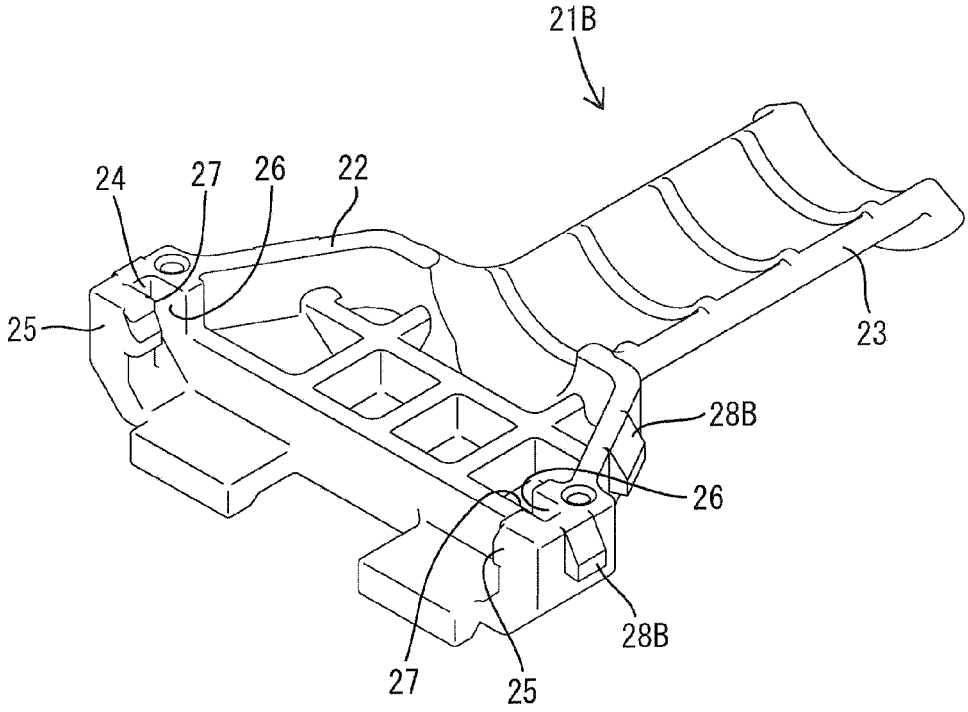
FIG. 10 is a perspective view of the lower cover.

An outward facing groove 14 is formed in each of the opposite left and right outer surfaces of the housing 10 near a rear end of the housing 10, as shown in FIGS. 7 to 9. Each outward facing groove 14 extends vertically and parallel to the connecting direction CD of the upper and lower covers 21A, 21B. Additionally, the outward facing grooves 14 are substantially bilaterally symmetrically arranged with respect to a virtual axis of symmetry S (see FIGS. 8 and 9) extending in forward and backward directions on a plane perpendicular to the connecting direction CD of the wire cover 20 to the housing 10. Note that the housing 10 and the wire cover 20 are substantially bilaterally symmetrical with respect to the virtual axis of symmetry S. Outward projections 15 are defined between the rear end of the housing 10 and the outward facing grooves 14. The projections 15 project laterally out like ribs and are substantially bilaterally symmetrical with respect to the virtual axis of symmetry S. Both the front and rear surfaces of the outward projections 15 are flat and perpendicular to a direction of the virtual axis of symmetry S (i.e. parallel to the assembling or connecting direction CD of the upper and lower covers 21A, 21B). The rear surfaces of the outward projections 15 define receiving portions 16.

Curved upper interference surfaces 17A extend through a quarter-circular arc when viewed from above and are disposed between upper end parts of the bottom surfaces of the grooves 14 and the front surfaces of the left and right outward projections 15, as shown in FIGS. 4, 5, 7 and 8. The upper interference surfaces 17A are substantially bilaterally symmetrical with respect to the virtual axis of symmetry S. Additionally, all of each upper interference surface 17A is oblique to the forward and backward direction, which is parallel to the virtual axis of symmetry S, and oblique to the width direction, which is perpendicular to the virtual axis of symmetry S. The upper interference surfaces 17A also define upper guide surfaces 18A with radii of curvature that gradually increase toward the top in their entire areas and which are slightly inclined with respect to the vertical direction. These upper interference surfaces 17A (upper guide surfaces 18A) are inclined in a direction to be more distant from a connection path with interference portions 27 of the upper cover 21A to be described later toward the upper side.

Figure 4:
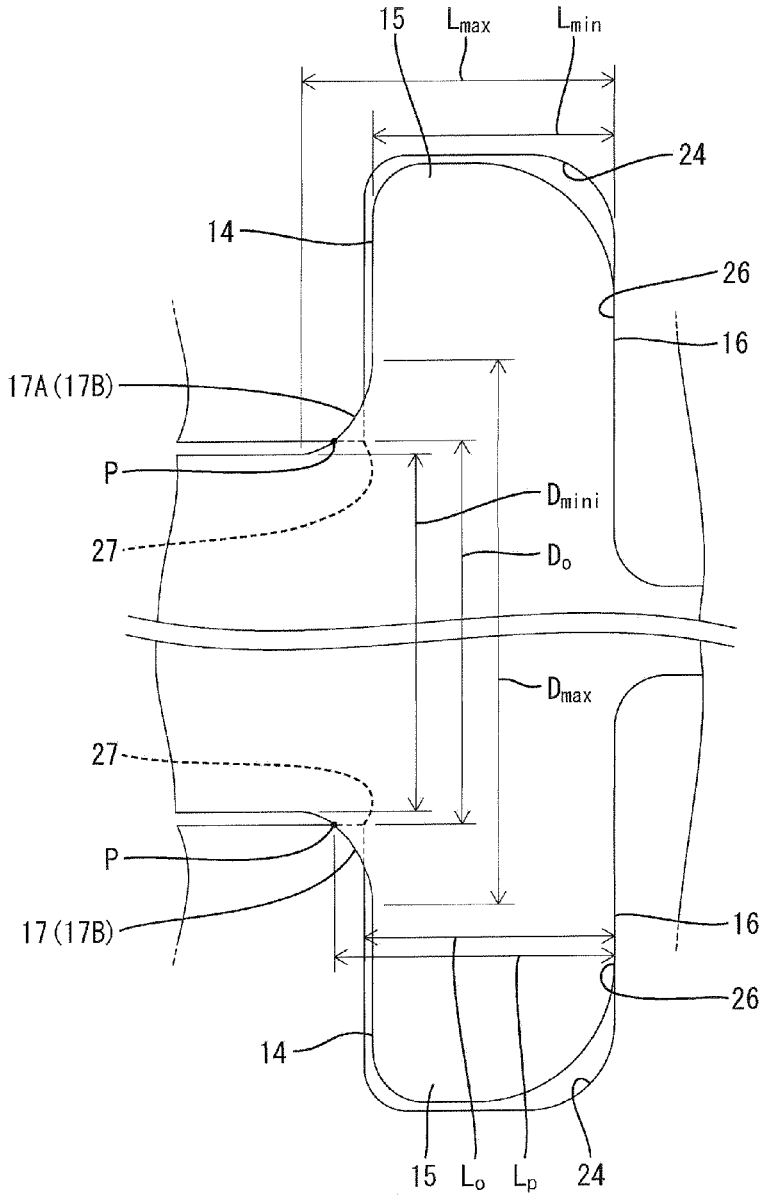
FIG. 4 is a partial enlarged plan view showing a backlash preventing structure in a state where a lower cover is mounted on a housing.
Figure 5:
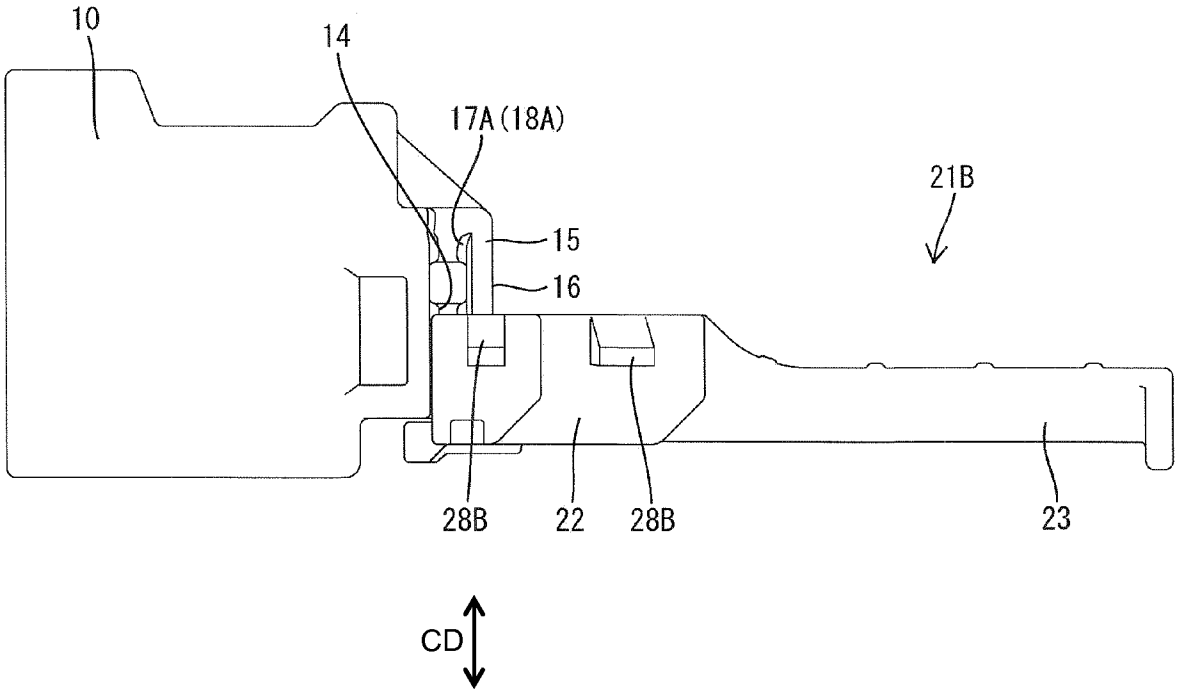
FIG. 5 is a side view showing the lower cover mounted on the housing.

Lower interference surfaces 17B extend through a quarter-circular arc when viewed from below and are disposed between lower end parts of the bottom surfaces of the grooves 14 and the front surfaces of the left and right outward projections 15, as shown in FIGS. 4, 7 and 9. The lower interference surfaces 17B are substantially bilaterally symmetrical with respect to the virtual axis of symmetry S. Additionally, all of each lower interference surface 17B is oblique to the forward and backward direction, which is parallel to the virtual axis of symmetry S, and oblique to the width direction, which is perpendicular to the virtual axis of symmetry S. The lower interference surfaces 17B also define lower guide surfaces 18B with radii of curvature that gradually increase toward the bottom in their entire areas and which are slightly inclined with respect to the vertical direction. These lower interference surfaces 17B (lower guide surfaces 18B) are inclined in a direction to be more distant from a connection path with interference portions 27 of the lower cover 21A to be described later toward the lower side.

Figure 6:
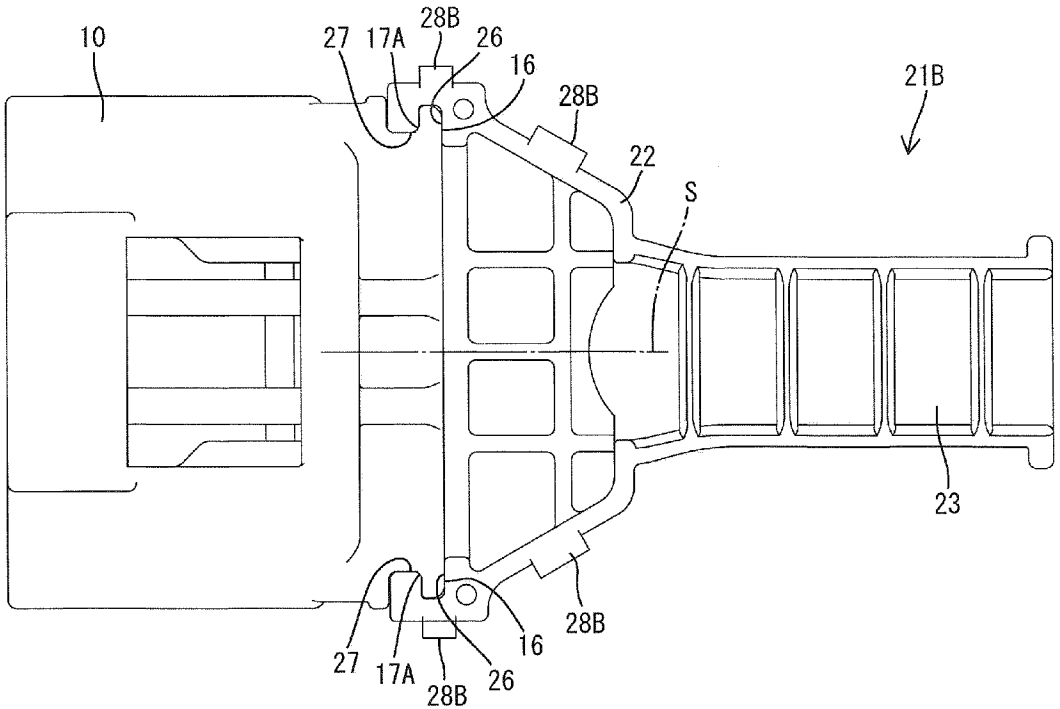
FIG. 6 is a plan view showing the lower cover mounted on the housing.
Figure 11:
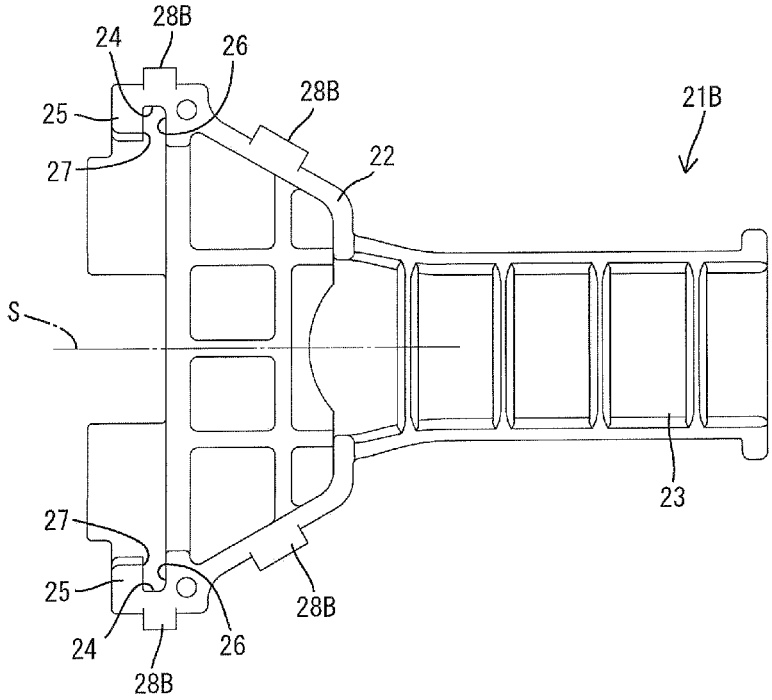
FIG. 11 is a plan view of the lower cover.
Figure 12:
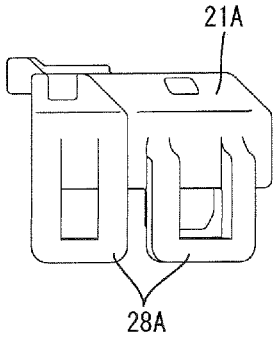
FIG. 12 is a side view of an upper cover.

As shown in FIGS. 3, 6 and 11, the lower cover 21B is substantially bilaterally symmetrical with respect to the virtual axis of symmetry S (see FIG. 11) and is a unitary structure with an upwardly recessed wide portion 22 and a narrow portion 23 extending back from the rear end of the wide portion 22. The wide portion 22 is shaped to be widest at its front end and gradually narrows toward the rear. As shown in FIG. 11, two inward facing grooves 24 are formed in inner surfaces of lateral walls of a front end portion of the lower cover 21B (wide portion 22) and extend in the vertical direction. The inward facing grooves 24 are open at the upper surface of the wide portion 22 and are bilaterally symmetrical with respect to the virtual axis of symmetry S. Inward projections 25 project in like ribs at positions between the front end surface of the lower cover 21B and the front surfaces of the lower inward facing grooves 24. The inward projections 25 extend vertically and are substantially bilaterally symmetrical with respect to the virtual axis of symmetry S.

Figure 13:
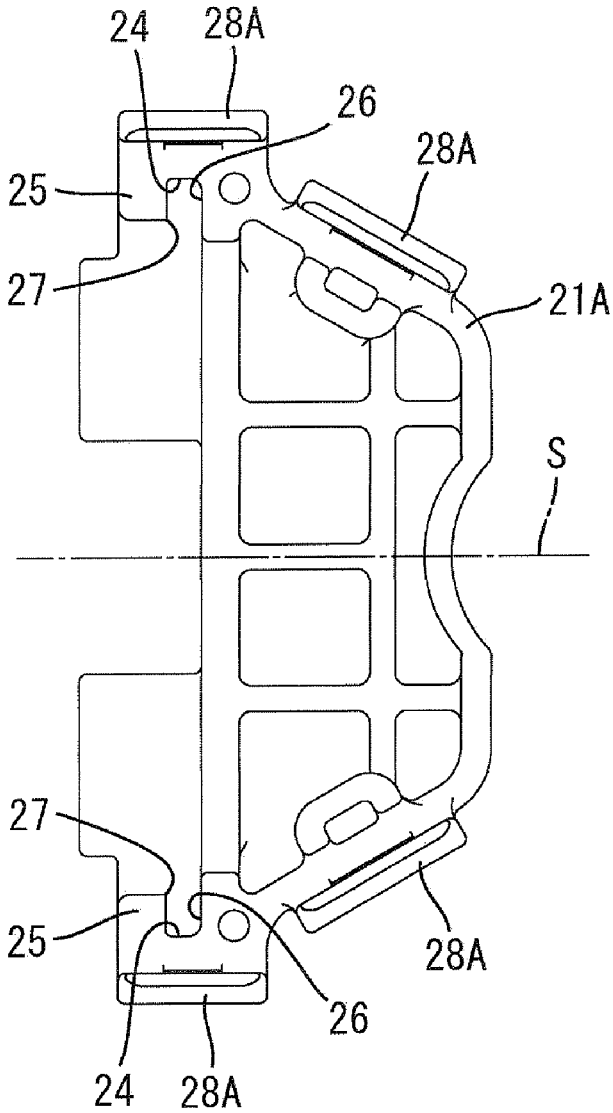
FIG. 13 is a bottom view of the upper cover.

As shown in FIG. 13, the upper cover 21A is substantially bilaterally symmetrical with respect to the virtual axis of symmetry S and has a recessed lower surface that corresponds only to the wide portion 22 of the lower cover 21B. The upper cover 21A is widest at its front end and gradually narrows toward the rear. Two inward facing grooves 24 are formed in inner surfaces of lateral walls of a front end portion of the upper cover 21A and extend in the vertical direction. The inward facing grooves 24 are open at the lower surface of the upper cover 21A and are bilaterally symmetrical with respect to the virtual axis of symmetry S. Inward projections 25 project in like ribs at positions between the front end surface of the upper cover 21A and the front surfaces of the lower inward facing grooves 24. The inward projections 25 extend vertically and are substantially bilaterally symmetrical with respect to the virtual axis of symmetry S.

As shown in FIGS. 4, 11 and 13, the opposed front and rear surfaces of the inward facing grooves 24 of the lower and upper covers 21B, 21A and the rear surfaces of the inward facing grooves 24 are substantially are flat and perpendicular to the direction of the virtual axis of symmetry S (i.e. parallel to the assembling or connecting direction CD of the upper and lower covers 21A, 21B). The rear surfaces of the inward facing grooves 24 define contact portions 26. Interference portions 27 are defined where the rear surfaces of the inward projections 25 meet the inner side surfaces of the inward projections 25 and are right-angled when viewed from above or below. The interference portions 27 are substantially bilaterally symmetrical with respect to the virtual axis of symmetry S.

Front and rear locks 28B project from each outer side surface of the wide portion 22 of the lower cover 21B, as shown in FIGS. 1 to 3, 5, 6, 10 and 11. Additionally, front and rear lock pieces 28A project from each outer side surface of the upper cover 21A, as shown in FIGS. 1 to 3, 12 and 13. The locks 28B and the lock pieces 28A engage when the upper and lower covers 21A, 21B are assembled to form the wire cover 20 and the wire cover 20 is locked with the housing 10 in its assembled state.

To assemble the connector, the terminal fittings 12 are inserted into the housing 10 and then the lower cover 21B is assembled with the housing 10 from below. In assembling, the inward projections 25 of the lower cover 21B are fit into the of outward facing grooves 14 of the housing 10 and the outward projections 15 are fit into the inward facing grooves 24. Thus, the contact portions 26 come into surface contact with lower end areas of the receiving portions 16 from behind and the left and right interference portions 27 contact the left and right lower interference surfaces 17B obliquely from the front.

The upper cover 21A then is assembled with the housing 10 and the lower cover 21B from above and along the connecting direction CD. More particularly the inward projections 25 of the upper cover 21A are fit into the outward facing grooves 14 of the housing 10 and the outward projections 15 are fit into the inward facing grooves 24. Thus, the contact portions 26 come into surface contact with upper end areas of the receiving portions 16 from behind and the left and right interference portions 27 come into contact with the left and right upper interference surfaces 17A obliquely from the front.

As shown in FIG. 4, Lmax denotes a maximum dimension from the receiving portions 16 to the interference surfaces 17A (17B) in the forward and backward directions (direction parallel to the virtual axis of symmetry S), Lmin denotes a minimum dimension from the receiving portions 16 to the interference surfaces 17A (17B) in forward and backward directions, Dmax denotes a maximum dimension between the interference surfaces 17A (17B) in the width direction (direction perpendicular to the virtual axis of symmetry S) and Dmin denotes a minimum dimension between the pair of interference surfaces 17A (17B) in the width direction. Further, Lo denotes a dimension from the receiving portions 26 to the interference portions 27 in forward and backward directions and Do denotes a dimension between the pair of interference portions 27 in the width direction. Furthermore, P denotes a position where the dimension between the interference surfaces 17A (17B) in the width direction is equal to the dimension Do between the pair of interference portions 27 in the width direction, and Lp denotes a dimension from the position P to the receiving portions 16 in forward and backward directions.

The above dimensions Lmax, Lmin, Lo, Dmax, Dmin and Do are set to have such a dimensional relationship as to satisfy the following inequalities (1) and (2):

$$Lmax>Lo>Lmini \quad (1)$$

$$Dmax>Do>Dmini \quad (2)$$

Further, the above dimensions Lp, Lo are set to have such a dimensional relationship as to satisfy the following inequation (3):

$$Lp>Lo \quad (3).$$

By setting the dimensions in this way, in the connecting process, the interference portions 27 come into contact with the interference surfaces 17A (17B) and reliably bite in or engage the interference surfaces 17A (17B) while being plastically compressed and deformed. At this time, the interference surfaces 17A (17B) also are deformed plastically to be slightly concave. Further, contact areas of the interference surfaces 17A (17B) with the interference portions 27 are only partial areas in the horizontal direction (direction perpendicular to the connecting direction CD). By this biting or engagement, relative displacements of the housing 10 and the lower cover 21B in horizontal directions both parallel to the virtual axis of symmetry S and perpendicular to the virtual axis of symmetry S are prevented to prevent backlash of the housing 10 and the lower cover 21B. Relative displacements in the two horizontal directions are also prevented between the housing 10 and the upper cover 21A to prevent backlash of the housing 10 and the upper cover 21A.

As described above, the housing 10 particularly is formed with the two interference surfaces 17A (17B) symmetrical with respect to the virtual axis of symmetry S that extends in forward and backward directions and are oblique to the virtual axis of symmetry S. The receiving portions 16 are spaced apart from the interference surfaces 17A (17B) in forward and backward directions parallel to the virtual axis of symmetry S. The wire cover 20 is formed with the two interference portions 27 that can contact only parts of the pair of interference surfaces 17A (17B) and are substantially symmetrical with respect to the virtual axis of symmetry S. The wire cover 20 also has the contact portions 26 that can come into contact with the receiving portions 16. The pair of interference surfaces 17A (17B), the receiving portions 16, the pair of interference portions 27 and the contact portions 26 all extend substantially in the vertical direction, i.e. the connecting direction of the upper and lower covers 21A, 21B to the housing 10. The interference surfaces 17A (17B) and the interference portions 27 are held in contact while being plastically deformed and the receiving portions 16 and the contact portions 26 are held in contact when the housing 10 and the wire cover 20 are connected. Accordingly, the backlash of the housing 10 and the wire cover 20 can reliably be prevented in the forward and backward directions parallel to the virtual axis of symmetry S and the lateral direction perpendicular to the virtual axis of symmetry S.

The upper and lower interference surfaces 17A, 17B are formed respectively with upper and lower guide surfaces 18A, 18B that are oblique to the vertical connecting direction CD of the housing 10 and the wire cover 20. According to this construction, the guide surfaces 18A, 18B correct displacements of the housing 10 and the wire cover 20 in the process of connecting the housing 10 and the wire cover 20. Therefore connection operability is improved.

Further, the wire cover 20 is formed by assembling the upper and lower covers 21A, 21B to the housing 10 in the direction substantially parallel to the connecting direction CD for vertically sandwiching or clamping the housing 10. Furthermore, the engagement of the locks 28B and the lock pieces 28A lock the upper and lower covers 21A, 21B in their connected state. The housing 10 is in contact with the inclined guides of the upper and lower covers 21A, 21B when the locks 28B and the lock pieces 28A are engaged to prevent separation of the upper and lower covers 21A, 21B. According to this construction, backlash also is prevented between the upper and lower covers 21A, 21B in the vertical connecting and separating directions.

The invention is not limited to the above described and illustrated embodiment. For example, the following embodiments also are included in the scope of the invention.

The interference surfaces are oblique to the connecting direction and the interference portions, and the receiving portions and the contact portions are parallel to the connecting direction in the above embodiment. However, only the interference portions, the receiving portions or the contact portions may be oblique to the connecting direction; only the interference surfaces, the interference portions or the contact portions may be oblique to the connecting direction; the interference surfaces and the interference portions may be parallel to the connecting direction and the receiving portions and the interference portions may be oblique to the connecting direction; the receiving portions and the contact portions may be parallel to the connecting direction and the interference surfaces and the interference portions may be oblique to the connecting direction; all of the interference surfaces, the interference portions, the receiving portions and the contact portions may be oblique to the connecting direction; or all of the interference surfaces, the interference portions, the receiving portions and the contact portions may be parallel to the connecting direction.

Both the interference portions and the interference surfaces are plastically deformed in the above embodiment when the interference portions and the interference surfaces come into contact. However, only the interference portions may be plastically deformed or only the interference surfaces may be plastically deformed.

The interference surfaces are arcuate and have angles of inclination with respect to the virtual axis of symmetry that are not uniform in the above embodiment. However, they may be flat surfaces with uniform angles of inclination to the virtual axis of symmetry.

The interference surfaces facing in the direction opposite to the receiving portions in the direction parallel to the virtual axis of symmetry in the above embodiment. However, they may face toward the receiving portions in the direction parallel to the virtual axis of symmetry. In this case, when Do denotes a dimension between the interference portions in the direction perpendicular to the virtual axis of symmetry, Lo denotes a dimension from the contact portions to the interference portions in the direction parallel to the virtual axis of symmetry and Lp denotes a dimension from the receiving portions to positions on the pair of interference surfaces where the dimension between the pair of interference surfaces is Do, the interference surfaces and the interference portions can be brought reliably into contact to prevent backlash if the dimensions Lp, Lo are so set as to satisfy $Lp<Lo$.

Two second components are connected to one first component in the above embodiment. However, the number of the second components to be connected to one first component may be one, three or more.

One first component of the connector is provided in the above embodiment. However, a plurality of first components may be provided. In this case, only one second component may be provided or a plurality of second components may be provided.

Although the first component is the housing and the second component is the wire cover in the above embodiment, the first component may be the wire cover and the second component may be the housing.

Although the case of connecting the housing and the wire cover is described in the above embodiment, the present invention is not limited to a connection structure for the housing and the wire cover and may be applied to various structures for connecting a plurality of components of a connector, such as a connection structure for components other than a housing and a wire cover (e.g. a retainer for retaining terminal fittings housed in the housing, a holder for retaining a rubber plug mounted on the housing), a connection structure for a plurality of constituent components of a housing (e.g. a combination of a housing main body for housing parts of terminal fittings except their front end portions and a front member for housing the front end portions of the terminal fittings), a connection structure for a plurality of constituent components of a wire cover, a connection structure for a male housing and a female housing, a connection structure for an inner housing and an outer housing, a connection structure for a frame and a plurality of sub-housings to be fitted into the frame in a divided connector and a connection structure for a housing and an alignment plate in a board connector.

What is claimed is:

1. A connector, comprising:

a first component made of synthetic resin;

a second component made of synthetic resin and connected to the first component;

two interference surfaces formed on the first component and extending substantially along a connecting direction of the first and second components, the interference surfaces being symmetrical with respect to a virtual axis of symmetry on a plane perpendicular to the connecting direction and oblique to the virtual axis of symmetry;

at least one receiving portion formed on the first component and extending substantially along the connecting direction, the receiving portion being spaced apart from the interference surfaces in a direction parallel to the virtual axis of symmetry;

two interference portions formed on the second component and extending substantially along the connecting direction, the interference portions contacting only parts of the interference surfaces and being symmetrical with respect to the virtual axis of symmetry; and at least one contact portion formed on the second component to extend substantially along the connecting direction and contacting the receiving portion, wherein the interference surfaces and the interference portions are held in contact while at least one of the interference surfaces and the interference portions being at least partly plastically deformed when the first and second components are connected and the receiving portion and the contact portion are held in contact.

2. The connector of claim 1, wherein, when Lmax denotes a maximum dimension from the receiving portion to the interference surfaces in the direction parallel to the virtual axis of symmetry, Lmin denotes a minimum dimension from the receiving portion to the interference surfaces in the direction parallel to the virtual axis of symmetry, Lo denotes a dimension from the contact portion to the interference portions in the direction parallel to the virtual axis of symmetry, Dmax denotes a maximum dimension between the pair of interference surfaces in a direction perpendicular to the virtual axis of symmetry, Dmin denotes a minimum dimension between the pair of interference surfaces in the direction perpendicular to the virtual axis of symmetry and Do denotes a dimension between the pair of interference portions in the direction perpendicular to the virtual axis of symmetry, the dimensions Lmax, Lmin, Lo, Dmax, Dmin and Do satisfy inequalities and;

$$Lmax>Lo>Lmini \quad (1)$$

$$Dmax>Do>Dmini \quad (2)$$

3. The connector of claim 2, wherein:

the interference surfaces are facing in a direction opposite to the receiving portion (16) in the direction parallel to the virtual axis of symmetry; and dimensions Lp, Lo are set to satisfy the following inequality:

$$Lp>Lo \quad (3)$$

when Lp denotes a dimension from the receiving portion to positions on the interference surfaces where the dimension between the interference surfaces is Do.

4. The connector of claim 1, wherein at least one of the interference surfaces, the receiving portion, the interference portions and the contact portion is formed with a guide portion oblique to the connecting direction.

5. The connector of claim 1, wherein the second component includes first and second elements that are connected to the first component in opposite directions while sandwiching the first component.

6. The connector of claim 5, wherein the first and second elements are locked in their connected state by the engagement of locks.

7. The connector of claim 6, wherein the first component and the first and second elements are held in contact at the guide portion in a state where the locks are engaged with each other to prevent separation of the first and second elements.

8. The connector of claim 1, wherein the first and second components are bilaterally symmetrical with respect to the virtual axis of symmetry.

9. The connector of claim 1, wherein at least parts of the interference surfaces are plastically deformed to be slightly concave when the first and second components are connected and the receiving portion (16) and the contact portion are held in contact.

10. The connector of claim 1, wherein a contact area of the interference surfaces with the interference portion is only partial areas in a direction perpendicular to the connecting direction.

11. A connector, comprising:

a housing made of synthetic resin;

first and second wire covers made of synthetic resin and connected to the housing;

two interference surfaces formed on the housing and extending substantially along a connecting direction of the wire covers with the housing, the interference surfaces being symmetrical with respect to a virtual axis of symmetry on a plane perpendicular to the connecting direction and oblique to the virtual axis of symmetry;

receiving portions formed on the housing and extending substantially along the connecting direction, the receiving portions being spaced from the interference surfaces in a direction parallel to the virtual axis of symmetry;

two interference portions on each of the first and second wire covers and extending substantially along the connecting direction, the interference portions contacting only parts of the interference surfaces and being symmetrical with respect to the virtual axis of symmetry; and two contact portions on each of the first and second wire covers and extending substantially along the connecting direction, the contact portions contacting the receiving portions, wherein the interference surfaces and the interference portions are held in contact while at least one of the interference surfaces and the interference portions are at least partly plastically deformed when the first and second wire covers are connected with the housing and the receiving portions and the contact portions are held in contact.

12. The connector of claim 11, wherein, when Lmax denotes a maximum dimension from the receiving portions to the interference surfaces in the direction parallel to the virtual axis of symmetry, Lmin denotes a minimum dimension from the receiving portions to the interference surfaces in the direction parallel to the virtual axis of symmetry, Lo denotes a dimension from the contact portion to the interference portions in the direction parallel to the virtual axis of symmetry, Dmax denotes a maximum dimension between the pair of interference surfaces in a direction perpendicular to the virtual axis of symmetry, Dmin denotes a minimum dimension between the pair of interference surfaces in the direction perpendicular to the virtual axis of symmetry and Do denotes a dimension between the pair of interference portions in the direction perpendicular to the virtual axis of symmetry, the dimensions Lmax, Lmin, Lo, Dmax, Dmin and Do satisfy inequalities and;

$$Lmax>Lo>Lmini \quad (1)$$

$$Dmax>Do>Dmini \quad (2)$$

13. The connector of claim 12, wherein:

the interference surfaces are facing in a direction opposite to the receiving portions in the direction parallel to the virtual axis of symmetry; and dimensions Lp, Lo are set to satisfy the following inequality:

$$Lp>Lo \quad (3)$$

when Lp denotes a dimension from the receiving portion to positions on the interference surfaces where the dimension between the interference surfaces is Do.

14. The connector of claim 11, wherein the first and second wire covers are connected to the housing in opposite directions while sandwiching the housing.

15. The connector of claim 14, wherein the first and second wire covers are locked in their connected state by an engagement of locks.

* * * * *